United States Patent [19]

Pippin et al.

[11] Patent Number: 4,804,165

[45] Date of Patent: Feb. 14, 1989

[54] STAKE PULLING APPARATUS

[76] Inventors: Archie A. Pippin, Rt. 2, Box 211; Wilton S. Perryman, Jr., Rt. 2, Box 157, both of Minden, La. 71055

[21] Appl. No.: 98,304

[22] Filed: Sep. 18, 1987

[51] Int. Cl.[4] ..... E21B 19/00

[52] U.S. Cl. ..... 254/30; 254/132

[58] Field of Search ..... 254/18, 29 R, 30, 31, 254/93 R, 132, 133

[56] References Cited

U.S. PATENT DOCUMENTS

| | | | |
|---|---|---|---|
| 2,967,044 | 1/1961 | Corcreham et al. | 254/30 |
| 3,290,005 | 12/1966 | Beemsterboer et al. | 254/18 |
| 3,773,292 | 11/1973 | Thiermann | 254/30 |

*Primary Examiner*—Robert C. Watson

*Attorney, Agent, or Firm*—John M. Harrison

[57] ABSTRACT

A stake pulling apparatus which is characterized by an upright box-frame adapted to contain a quantity of hydraulic fluid, a bifurcated base plate attached to the bottom of the frame for supporting the frame, a hydraulic cylinder pivotally suspended from the frame over the slot provided in the base, a hydraulic pump provided in fluid communication with the box-frame hydraulic fluid reservoir, a gasoline engine for powering the apparatus and a hydraulic control system for controlling the introduction of hydraulic fluid into the hydraulic cylinder to remove a stake embedded in the ground and located in the slot beneath the hydraulic cylinder. In a preferred embodiment, a chain is wrapped around the stake and attached to the cylinder piston, in order to secure the piston to the stake and effect extraction of the stake from the ground.

4 Claims, 2 Drawing Sheets

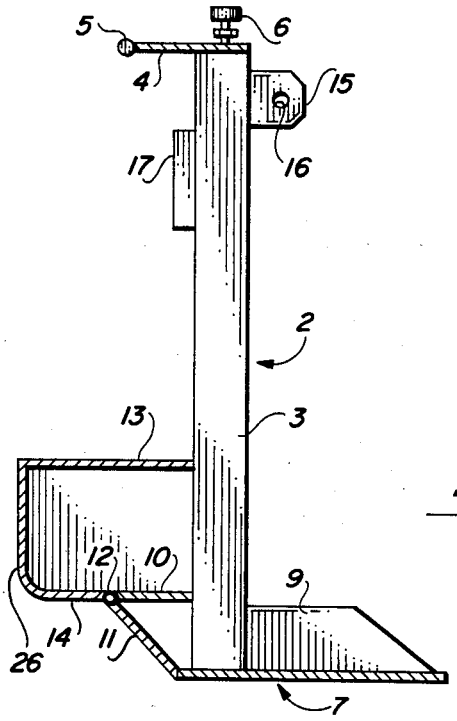
FIG. 4
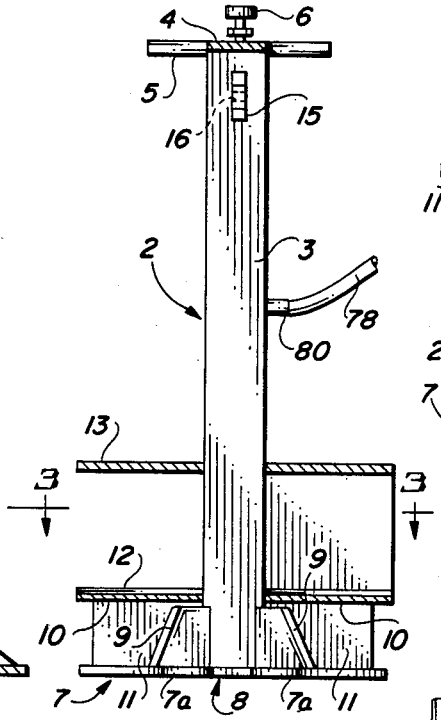
FIG. 2
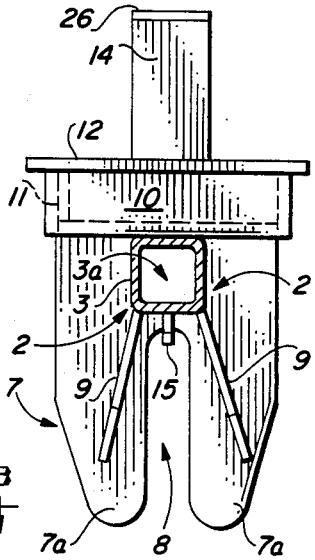
FIG. 3
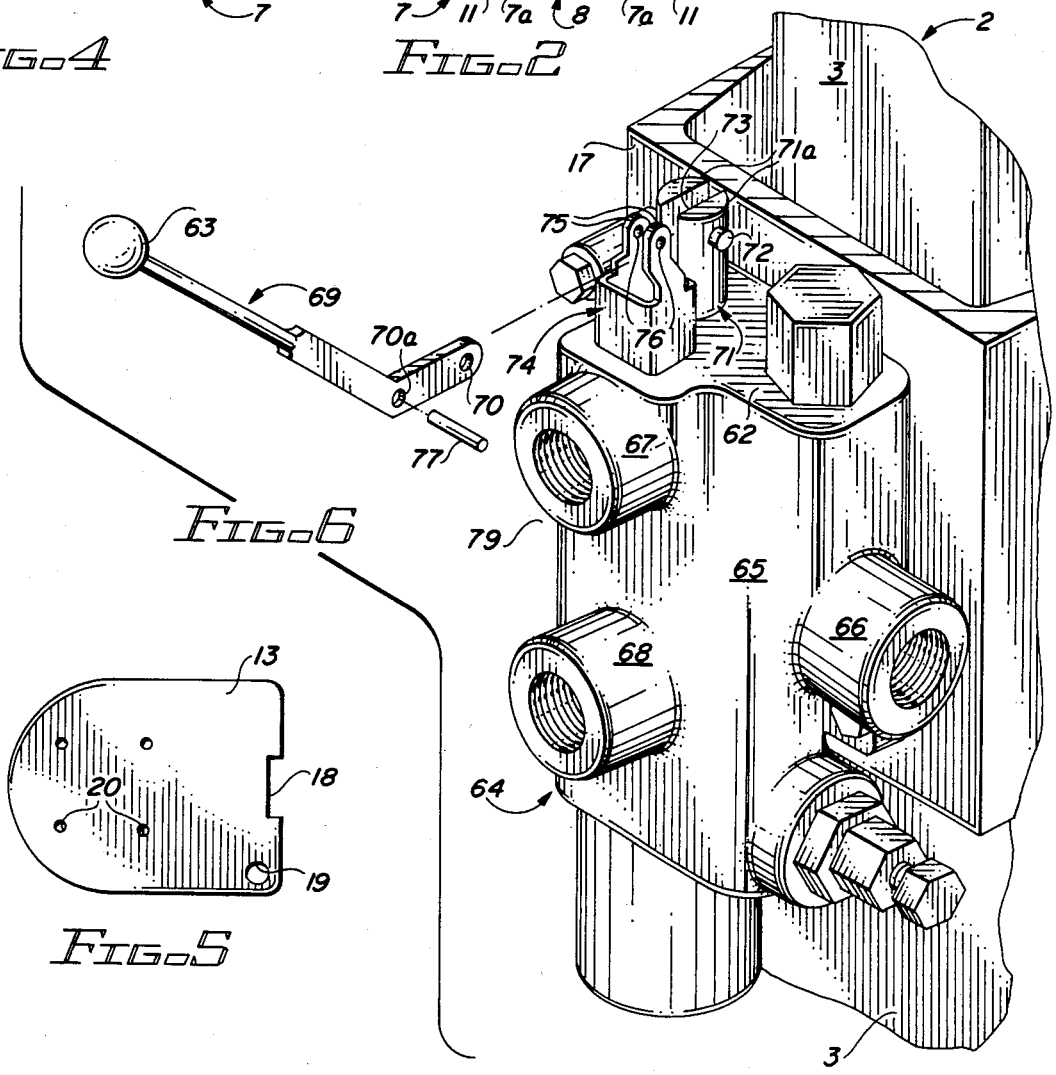
FIG. 6
FIG. 5

STAKE PULLING APPARATUS

BACKGROUND OF THE INVENTION

1. Field of the Invention

This invention relates to apparatus for removing stakes which are deeply embedded in the ground or in asphalt pavement. More particularly, the invention relates to a stake pulling apparatus for removing tent and awning stakes from the ground or from asphalt paving and underlying terrain, under circumstances where the stakes are deeply embedded in the ground and/or asphalt paving. The stake pulling apparatus of this invention is characterized by an upward-standing box-frame or tubular member which serves as a reservoir for hydraulic fluid, a bifurcated base plate welded or otherwise attached to the frame for supporting the frame in upright position and a hydraulic cylinder pivotally attached to the frame and adapted for positioning over a stake to be removed from the ground or from the asphalt paving. The apparatus is maneuvered to locate the stake in the slot provided in the base plate and a hydraulic pump, pump motor and control system are provided on the frame for controlling the flow of hydraulic fluid to the hydraulic cylinder and operation of the cylinder piston responsive to operation of the controls.

One of the problems realized in the erection of tents, canopies and other temporary structures which are secured in position by stakes, ropes and cables is that of removing the deeply embedded stakes from ground or asphalt surfaces. Under circumstances where the tent, canopy or other structure to be erected is relatively large, the stakes must be long and deeply embedded in the ground or asphalt and are therefore very difficult to remove. Because of the difficulty of removing these stakes, in many cases, the stakes must be left embedded in the ground and in some instances, are simply driven further into the ground or asphalt flush with the surface of the ground or asphalt after use, to prevent injury. In the case of large canopies such as circus tents, these stakes may be steel spikes 2 to 4 feet in length and 1 to ½ inches in diameter and may be driven into the ground or asphalt to within about 5 or 6 inches of the top end thereof. The difficulty of removing such stakes from the ground or asphalt paving after striking the tent can be readily appreciated. Since many such tent stakes or spikes are necessary to secure a circus tent or other large canopy, failure to remove these stakes after the performance or event is completed results in a considerable loss of revenue.

2. Description of the Prior Art

Various devices are known in the art for removing embedded railroad spikes from cross ties in railroad maintenance operations. Typical of these machines is the "spike pulling machine" disclosed in U.S. Pat. No. 2,691,505, dated Oct. 12, 1954, to S. R. Hursh. The spike pulling machine detailed in this patent includes a compact, light-weight and readily portable machine for withdrawing spikes from objects such as railroad ties, which device is fluid-operated and is braced against a track rail to effect withdrawal of the spikes from the ties of the track bed. The spike pulling machine includes a base, a rigid frame slidably mounted on the base, a grapple suspended from the frame and oriented in position to engage and disengage a spike to be pulled, a jack element located on the base for sliding the rigid frame up and down relative to the base, operating means for operating the jack element, control means for activating and inactivating the operating means and limit means connected to the jack element and operative in response to the movement of the frame for operating the control means and thereby inactivating the jack-operating element when the frame and base reach predetermined positions relative to one another. U.S. Pat. No. 2,732,173, dated Jan. 24, 1956, to S. R. Hursh, discloses a "Spike Pulling Apparatus". The device detailed in this patent includes a truck provided with wheels constructed to move along a railroad track with additional adjustable wheels normally supported above the first set of wheels. The upper adjustable wheels are movable up and down to and from a lower, ground-engaging position and an elongated body member is pivoted to the track for swinging movement in an arc above the track at an angle extending upwardly with respect to the horizontal. The body member includes two body portions pivoted together by means of a substantially universal pivot, a spikepulling grapple carried by the body member and spaced along the body member from the truck, power means supported by the truck and flexible connecting means extending along the body member for connecting the power means to the grapple and operating the grapple. A "Pneumatic Spike Extractor" is disclosed in U.S. Pat. No. 2,735,649, dated Feb. 21, 1956, to S. A. Swallert. The extractor device detailed in this patent includes a pair of jaws which are pivotably mounted on the outer end of a rod fixed to a pressure-operated piston. The piston is enclosed in a cylinder provided with devices for alternately connecting the chambers on both sides of the piston with a source of pressurized air. A locking member is arranged to lock the jaws in a position gripping the head of a nail when the piston rod is in an outer configuration. U.S. Pat. No. 2,797,889, dated July 2, 1957, to H. H. Talboys, discloses a "Hydraulic Spike Puller". The spike pulling implement detailed in this patent includes an elongated frame, a spike-gripping claw mounted for reciprocating movement at one end of the frame, the frame also including a portion adapted to bear against a surface external to an embedded spike, along with means for reciprocating the claw with respect to the frame to remove a spike from an embedded position. An opening is provided on one side of the frame adjacent the claw, the opening being generally co-extensive with the range of movement of the claw and a resilient arm is mounted on the other side of the frame for contact with the spike engaged by the claw and forcing the spike through the opening. U.S. Pat. No. 2,846,187, dated Aug. 5, 1958, to I. Sublett, et al, details a "Hydraulic Spike Pulling Apparatus". The device disclosed in this patent includes a movable, hydraulically-operated element for effecting movement of an object upon actuation of the element in one direction and a hydraulic pressure accumulator operatively connected to the element, with the hydraulic pump communicating with and supplying pressure to the element and the accumulator. The pressure provided by the pump effects initial actuation of the element in the one direction and the pressure accumulated within the accumulator supplements that of the pump in effecting final actuation of the element in the same direction. A "Machine For Pulling Pins" is disclosed in U.S. Pat. No. 2,911,190, dated Nov. 3, 1959, to F. Creason. This patent details a pin-extracting mechanism for removing forms located at the sides of concrete slabs in road and similar construction, the machine including a mobile frame adapted to be moved upon the slab alongside the form. A first fluid pressure-actuated mechanism is located on the frame for engaging and pulling the pins and a separate fluid pressure-actuating mechanism is also provided on the frame for engaging and applying a downward pressure on the form during actuation of the pin pulling means. A mechanism is also provided on the frame for manually controlling the fluid pressure to and from the fluid pressure-actuated mechanisms.

It is an object of this invention to provide a stake pulling apparatus which is designed to quickly, easily and efficiently remove wood and metal stakes driven into bare ground or asphalt-covered terrain.

Another object of the invention is to provide a new and improved stake pulling apparatus which is portable in construction and is capable of being located above a stake to be removed from the ground or from asphalt paving, which apparatus can then be attached to the stake and operated to quickly and efficiently remove the stake from the ground or asphalt.

Still another object of this invention is to provide a new and improved embedded stake pulling apparatus which is characterized by a hydraulic cylinder pivotally mounted on an upright frame fitted with an engine, a hydraulic motor and a control system for operating the hydraulic cylinder and removing stakes from the ground.

Yet another object of this invention is to provide a stake pulling apparatus which is portable in construction and includes a frame provided with a hydraulic fluid reservoir, a hydraulic cylinder pivotally attached to the frame, a hydraulic motor mounted on the frame and provided in fluid communication with the hydraulic cylinder and the reservoir, a two-cycle engine mounted on the frame for operating the hydraulic motor and a control system for selectively applying hydraulic pressure to the hydraulic cylinder and removing a stake embedded in the ground or asphalt paving and located beneath the hydraulic cylinder.

A still further object of this invention is to provide a stake pulling apparatus for removing stakes which are deeply embedded in the ground or in asphalt paving and in underlying terrain, which apparatus includes an upright box-frame or tubing designed to contain a quantity of hydraulic fluid and a base welded to the box-frame or tubing and having a slot for receiving an embedded stake. A hydraulic pump is mounted on the frame, along with a hydraulic cylinder, an engine adapted for operating the hydraulic pump and a control system for controlling the flow of hydraulic fluid from the box-frame or tubing to the hydraulic cylinder and removing the stake from the ground or asphalt responsive to retraction of the hydraulic cylinder piston.

SUMMARY OF THE INVENTION

These and other objects of the invention are provided in a new and improved portable stake pulling apparatus which is characterized by an upright, closed length of square tubing containing a supply of hydraulic fluid, a base resting on the ground and supporting the tubing, a hydraulic cylinder pivotally attached to the frame, a chain for connecting the cylinder piston to the stake, a hydraulic motor provided in fluid communication with the hydraulic fluid reservoir and the hydraulic cylinder, a small gasoline engine for operating the hydraulic pump and a control system for controlling application of hydraulic pressure to the hydraulic cylinder and removing a stake embedded in the ground or asphalt paving located beneath the hydraulic cylinder.

The invention will be better understood by reference to the accompanying drawings, wherein:

FIG. 2 is a front view, partially in section, of a preferred stake pulling apparatus frame;

FIG. 3 is a top sectional view taken along line 3—3 of the stake pulling apparatus frame illustrated in FIG. 2;

FIG. 4 is a side sectional view of the stake pulling apparatus frame illustrated in FIGS. 2 and 3;

FIG. 5 is a top view of an engine mount plate used to support and mount a gasoline engine in the stake pulling apparatus frame;

FIG. 6 is a perspective view, partially in section, of a preferred hydraulic control valve element of the stake pulling apparatus;

DESCRIPTION OF THE PREFERRED EMBODIMENTS

Figure 1:
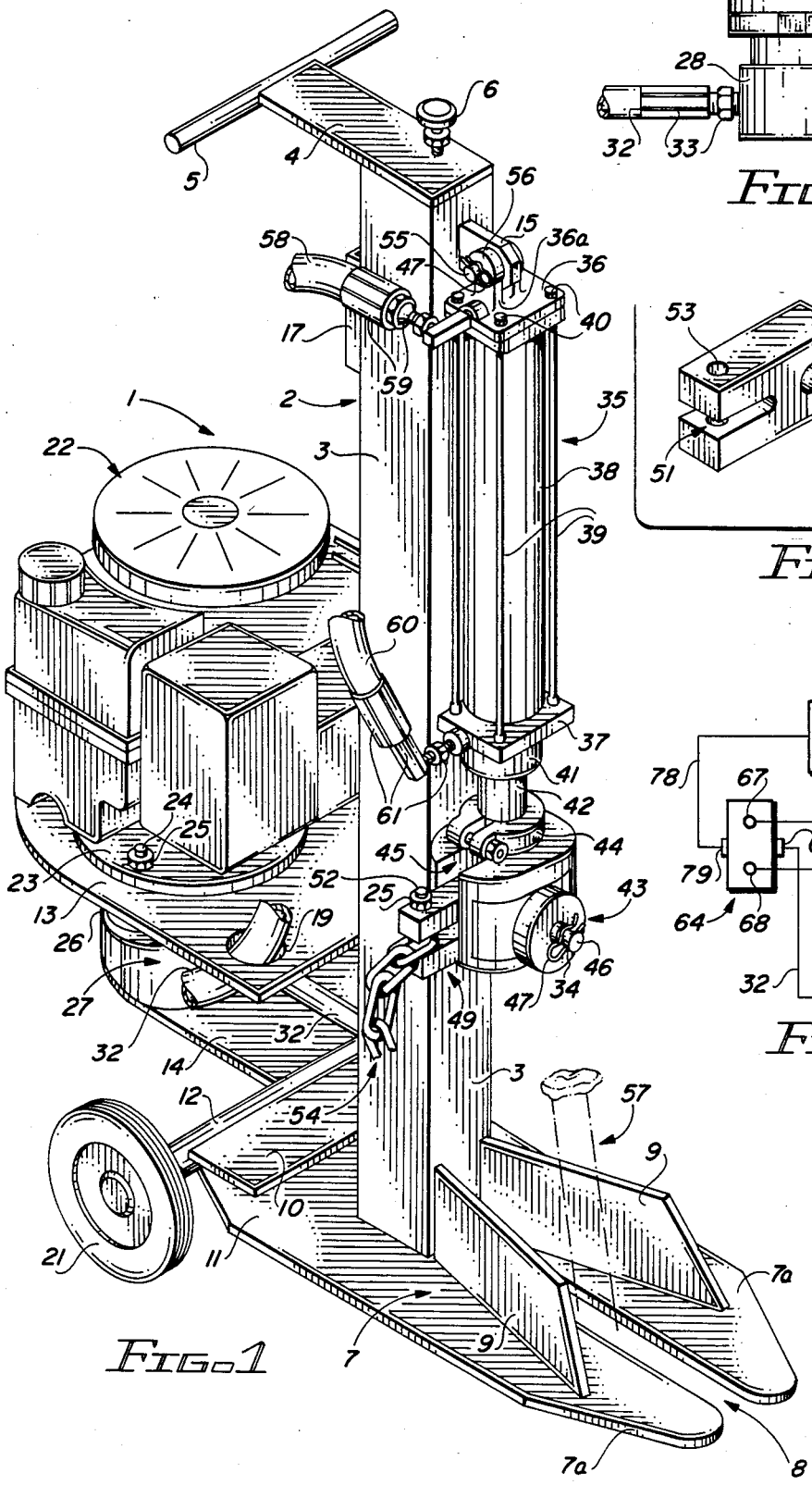
FIG. 1 is a perspective view of a preferred embodiment of the stake pulling apparatus of this invention.

Referring initially to FIGS. 1–5 of the drawings, the stake pulling apparatus of this invention is generally illustrated by reference numeral 1. The stake pulling apparatus 1 is characterized by a frame 2, having an upwardstanding hydraulic fluid reservoir 3, terminated at one end by a top plate 4 and at the bottom end by a supporting base plate 7. A handle 5 is attached to the extending end of the top plate 4 for maneuvering the stake pulling apparatus 1 and a dip stick 6 extends from the top plate 4 with an indicating portion (not illustrated) projecting into the hydraulic fluid reservoir 3, in order to indicate the hydraulic fluid level in the hydraulic fluid reservoir 3. In a preferred embodiment of the invention, the base plate 7 is characterized by a pair of plate fingers *7a* which extend outwardly of the hydraulic fluid reservoir 3, with a base plate slot 8 located between the plate fingers *7a*, for a purpose which will be hereinafter described. A pair of gussets 9 project outwardly from fixed attachment to the hydraulic fluid reservoir 3 and the plate fingers *7a*, in order to strengthen the weld attachment between the hydraulic fluid reservoir 3 and the base plate 7. An axle mount plate 10 is also welded to the hydraulic fluid reservoir 3 in spaced, substantially parallel relationship with respect to the base plate 7 and is further welded or otherwise attached to an axle 12 which receives a pair of wheels 21, one of which wheels 21 is illustrated in FIG. 1. An axle brace plate 11 is further welded to the rear edge of the base plate 7 and extends upwardly in angular relationship with respect to base plate 7. The opposite edge of the axle brace plate 11 is welded or otherwise secured to the axle 12, in order to further support the axle 12 on the base plate 7 and the hydraulic fluid reservoir 3. An engine mount plate 13 is further illustrated in FIG. 5 of the drawings and is fitted with a reservoir slot 18 for engaging and seating on the hydraulic fluid reservoir 3, as illustrated in FIG. 1. The engine mount plate 13 extends from welded or otherwise fixed attachment to the hydraulic fluid reservoir 3 at the reservoir slot 18 and projects in parallel relationship with respect to the base plate 7 above the axle 12, to provide a flat base for mounting a gasoline engine 22. The engine mount plate 13 is further fitted with a hose opening 19 and spaced mount openings 20, which mount openings 20 are designed to receive engine plate bolts 24 and cooperating nuts 25, which extend through the mount openings 20 and matching openings (not illustrated) provided in a cooperating engine plate 23, to secure the gasoline engine 22 on the engine mount 13, as illustrated in FIG. 1. A generally L-shaped plate brace 26 is oriented with one edge welded to the extending edge of the engine mount plate 13 and the opposite edge welded to a pump mount plate 14 welded to the axle 12, as more particularly illustrated in FIG. 4, to support the hydraulic pump 27, as illustrated in FIG. 1. As further illustrated in FIGS. 1, 2, 4 and 6 of the drawings, a cylinder mount bracket 15 is welded or otherwise secured to the front face of the hydraulic fluid reservoir 3 and is provided with a bracket eye 16 for pivotally mounting one end of the cylinder body 38 of the hydraulic cylinder 35, as illustrated in FIG. 1. Furthermore, a valve mount bracket 17 is welded or otherwise attached to the rear face of the hydraulic fluid reservoir 3 beneath the top plate 4 and the handle 5 for receiving a hydraulic control valve 64, as further illustrated in FIG. 6.

Figure 8:
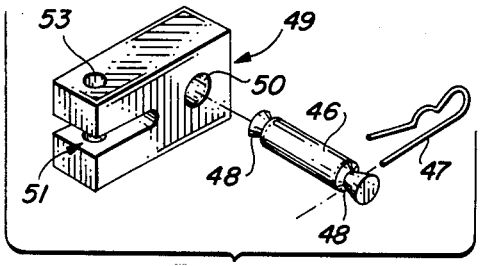
FIG. 8 is a perspective view of a preferred means for attaching a chain to the lower end of the hydraulic cylinder piston, in order to secure the piston to a stake to be removed from the ground.

Referring again to FIG. 1 of the drawing, the hydraulic cylinder 35 is characterized by a cylindrically-shaped cylinder body 38, capped by a top plate 36 and a bottom plate 37, which are connected by threaded connecting rods 39 and cooperating rod nuts 40. A top plate clevis 36*a* extends from the top plate 36 and is designed to engage the cylinder mount bracket 15, welded to the hydraulic fluid reservoir 3. A clevis pin 55 extends through registering openings (not illustrated) provided in the top plate clevis 36*a* and the bracket eye 16 located in the cylinder mount bracket 15, to pivotally secure the cylinder body 38 of the hydraulic cylinder 35 to the cylinder mount bracket 15. One or more cotter pins 47 are projected through the ends of the clevis pin 55 adjacent the pin washers 56, in order to prevent the clevis pin 55 from exiting the top plate clevis 36*a* and the cylinder mount bracket 15. A hydraulic fluid-operated piston 42 is mounted in conventional reciprocating fashion inside the cylinder body 38 of the hydraulic cylinder 35 at the piston collar 41 and the piston 42 is fitted with a piston clamp 43, mounted on the extending end of the piston 42 by means of a clamp collar 44. The piston clamp 43 further includes a vertical clamp slot 45, which pivotally receives a chain mount block 49 by means of a clamp pin 46 that extends transversely through the clamp washer 34, the piston clamp 43 and the clamp slot 45. As illustrated in FIG. 8, the chain mount block 49 further includes a chain slot 51 and a pin opening 50, spaced from and extending parallel to the chain slot 51, for receiving the clamp pin 46. The clamp pin 46 is further provided with a pair of pin grooves 48, located at the extending ends thereof for receiving a pair of cotter pins 47 and maintaining the clamp pin 46 in the piston clamp 43 and the pin opening 50 of the chain mount block 49, as illustrated in FIG. 1. A chain bolt opening 53 extends transversely through the chain mount block 49 and the chain slot 51 and receives a chain bolt 52, which is secured in place by a nut 25, as further illustrated in FIG. 1. Accordingly, it will be recognized that the chain bolt 52 can be removed from, and subsequently replaced in, the chain bolt opening 53 and the piston clamp 43 to secure one link of a chain 54 in the chain slot 51 and facilitate wrapping the chain 54 around a stake (not illustrated) for removing the stake from the ground pursuant to operation of the stake pulling apparatus 1, as hereinafter further described.

Figure 7:
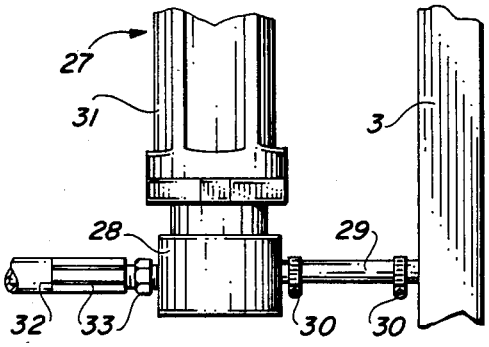
FIG. 7 is a side view, partially in section, of the lower end of a hydraulic pump illustrated in close proximity to the hydraulic fluid reservoir of the stake pulling apparatus of this invention.

Referring now to FIGS. 1 and 7 of the drawings, the hydraulic pump 27 is mounted on the pump mount plate 14 and is characterized by a pump housing 31, fitted with a fluid chamber 28 at the lower end thereof. A reservoir line 29 extends from the hydraulic fluid reservoir 3 to the fluid chamber 28 and is secured in position on cooperating nipples (not illustrated) extending from the hydraulic fluid reservoir 3 and the fluid chamber 28, respectively, by means of a pair of hose clamps 30, as illustrated in FIG. 7. Similarly, a pump discharge line 32 is connecting to the opposite side of the fluid chamber 28 of the hydraulic pump 27 by means of pump discharge fittings 33, in order to facilitate pumping hydraulic fluid from the hydraulic fluid reservoir 3 through the reservoir line 29 and the fluid chamber 28 of the hydraulic pump 27 and through the pump discharge line 32, as hereinafter further described.

Referring now to FIG. 6 of the drawings, the hydraulic control valve 64 is further characterized by a valve housing 65, which includes a pump discharge line nipple 66 projecting from one side thereof and a return line nipple 79 projecting from the opposite side thereof. A piston extension line nipple 67 and a piston return line nipple 68 project from the front face of the valve housing 65 in spaced relationship and a fulcrum 74 is secured to the top face 62 of the valve housing 65, as illustrated. The fulcrum 74 further includes a pair of fulcrum mount fingers 75, which project upwardly and are fitted with aligned finger openings 76 to receive a fulcrum pin 77, as hereinafter described. A valve stem 71 is spaced from the fulcrum 74 and projects upwardly from the valve housing 65 in reciprocating relationship and includes a vertical stem slot 73, which defines a pair of parallel stem fingers 71*a*, fitted with a transversely mounted, removable stem pin 72. An actuating lever 69 is provided with a grip ball 63 on one end and is flattened and curved on the opposite end, with a stem pin opening 70 and a fulcrum pin opening 70*a* provided in spaced relationship in the flattened, extending end of the actuating lever 69, as illustrated in FIG. 6. Accordingly, it is understood that the flattened, extending end of the actuating lever 69 is designed to fit in the stem slot 73 of the valve stem 71 and between the fulcrum mount fingers 75 of the fulcrum 74. The stem pin 72 is then extended through the projecting fingers 71*a* in the valve stem 71 and the registering stem pin opening 70. Furthermore, the fulcrum pin 77 extends through the finger openings 76 in the fulcrum mount fingers 75 and the registering fulcrum pin opening 70*a*, to facilitate reciprocation of the valve stem 71 upwardly and downwardly in the valve housing 65 by manipulation of the actuating lever 69.

Figure 9:
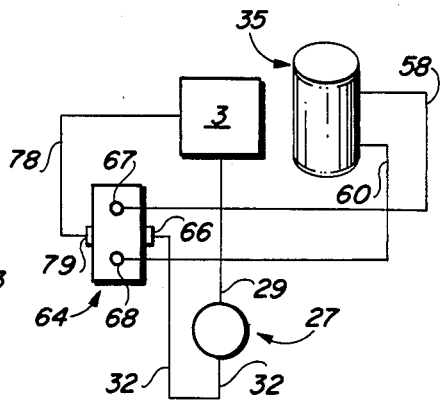
FIG. 9 is a schematic diagram illustrating the flow of hydraulic fluid through the stake pulling apparatus of this invention.

Referring now to FIGS. 1 and 9 of the drawings, one end of a piston extension line 58 is attached to the top plate 36 of the cylinder body 38 of the hydraulic cylinder 35 by means of companion piston extension fittings 59, as illustrated in FIG. 1. The opposite end of the piston extension line 58 is secured to the piston extension line nipple 67, projecting from the valve housing 65, by means of appropriate fittings (not illustrated), as illustrated in FIG. 9. Similarly, one end of the piston return line 60 is secured to the bottom plate 37 of the cylinder body 38 by means of cooperating piston return fittings 61. The opposite end of the piston return line 60 is secured to the piston return line nipple 68 of the hydraulic control valve 64 by means of additional fittings (not illustrated) as illustrated in FIG. 9. As heretofore described, one end of the pump discharge line 32 is attached to the fluid chamber 28 of the hydraulic pump 27 by means of the pump discharge fittings 33. The opposite end of the pump discharge line 32 extends through the hose opening 19 provided in the engine mount plate 13 and is secured to the pump discharge line nipple 66, projecting from the valve housing 65, as illustrated in FIG. 9. A fluid return line 78 is designed to facilitate the flow of hydraulic fluid from the hydraulic control valve 64 back to the hydraulic fluid reservoir 3 and extends from the return line nipple 79, located in the valve housing 65 of the hydraulic control valve 64, to the return line fitting 80 provided in the hydraulic fluid reservoir 3, as illustrated in FIG. 2.

Referring again to FIGS. 1, 6 and 9 of the drawings, in operation, the stake pulling apparatus 1 is initially located with a stake 57 (illustrated in phantom) to be removed positioned in the base plate slot 8 beneath the hydraulic cylinder 35, as illustrated in FIG. 1. The stake pulling apparatus is easily maneuvered into this position by grasping the handle 5 and maneuvering the wheels 21 such that the stake 57 is located well within the base plate slot 8 between the plate fingers 7*a* of the base plate 7. One end of the chain 54 is then attached to the chain mount block 49 by initially removing the nut 25 from the chain bolt 52 and the chain bolt 52 from the chain mount block 49, inserting a link of the chain 54 into the chain slot 51 and replacing the chain bolt 52 and the nut 25 in the chain mount block 49, as illustrated in FIG. 1. The opposite end of the chain 54 is then wrapped around the stake 57 and the actuating lever 69 in the hydraulic control valve 64 is manipulated to facilitate a flow of hydraulic fluid from the reservoir 3 through the reservoir line 29 and the fluid chamber 28 of the hydraulic pump 27 by operation of the hydraulic pump 27. Hydraulic fluid continues to flow from the hydraulic pump 27 through the pump discharge line 32 and into the pump discharge line nipple 66, through the valve housing 65 and the piston extension line nipple 67 and finally, through the piston extension line 58 into the top plate 36 of the cylinder body 38, to effect downward extension of the piston 42, such that piston clamp 43 is located in close proximity to the top of the stake 57 be removed. The free end of the chain 54 is then wrapped around the stake 57 and the piston 42 is reversed in operation by again manipulating the actuating lever 69 to cause hydraulic fluid to flow through the valve housing 65 and the piston return line nipple 68 and further through the piston return line 60 into the bottom plate 37 of the cylinder body 38. The hydraulic fluid returns to the hydraulic fluid reservoir 3 through the fluid return line 78, extending from the return line nipple 79 to the return line fitting 80. The retraction action of the piston 42 forces the plate fingers 7*a* and the base plate 7 downwardly against the ground as the stake 57 is extracted. If the stake 57 is longer than the travel of the piston 42 in the hydraulic cylinder 35, the stake pulling apparatus 1 can be manipulated such that the head 57*a* of the stake 57 extends alongside the piston clamp 43 and the free end of the chain 54 again wrapped around the stake near the midpoint thereof. The extraction procedure is then repeated to complete the stake-removing operation.

It will be appreciated by those skilled in the art that the stake removing apparatus of this invention offers a quick, efficient and simple solution to the removal of deeply embedded, metal or wood tent awning and mount stakes of all description. It will be further appreciated from a consideration of FIG. 1 that removal of such stakes from asphalt poses little danger of damage to the surface of the asphalt, since the plate fingers 7*a* and the base plate 7 of the frame 2 are pressed tightly against the asphalt surface as pressure is applied upwardly to the stake 57, thereby preventing extensive damage to the surface of the asphalt.

Furthermore, referring again to the drawings, while the overall dimensions and size of the stake pulling apparatus 1 of this invention can be varied according to the application desired, in a most preferred embodiment the frame 2 stands about 48 inches high and the stake pulling apparatus 1 weighs about 220 pounds. The hydraulic fluid reservoir 3 is characterized by a 4 inch by 4 inch square steel tubing and the base is 14 inches wide and 18 inches long. The wheels 21 are most preferably pneumatic in design and a 4-horsepower, two-cycle gasoline engine 22 is used to power the stake pulling apparatus 1. A two-stage hydraulic pump 27, which is capable of pumping eleven gallons of hydraulic fluid per minute in a pressure range of from about 650 to about 2,500 psi, is used in the stake pulling apparatus 1. The hydraulic cylinder 35 is typically of the clevis-type, to facilitate mounting the cylinder body 38 to the cylinder mount bracket 15 and is characterized by a 3 ½-inch bore with a 12-inch stroke. The hydraulic cylinder 35 is double-action in design and is capable of maintaining a pulling force of from about 8,400 to about 21,000 pounds. Furthermore, a 60-inch length of ⅜-inch high test steel chain 54 is normally used in cooperation with the stake pulling apparatus 1 to connect the piston 42 to the stake 57.

While the preferred embodiments of the invention have been described above, it will be recognized and understood that various modifications may be made therein and the appended claims are intended to cover all such modifications which may fall within the spirit and scope of the invention.

Having described our invention with the particularities set forth above, what is claimed is:

1. A stake pulling apparatus for removing a stake from the ground, comprising a base plate adapted for engaging the ground and located in close proximity to the stake; an upward-standing frame carried by said base plate and a hydraulic fluid reservoir provided in said frame for containing a supply of hydraulic fluid; a hydraulic fluid pump mounted on said frame, said hydraulic fluid pump provided in fluid communication with the hydraulic fluid in said hydraulic fluid reservoir; a hydraulic control valve mounted on said frame and a control lever pivotally carried by said hydraulic control valve for controlling the flow of hydraulic fluid from said hydraulic fluid reservoir; a hydraulic cylinder characterized by a pressure cylinder pivotally carried by said frame and a downwardly-extending piston adapted for reciprocating travel in said pressure cylinder, said piston and said pressure cylinder provided in fluid communication with said control valve; a clamp carried by the downwardly-extending end of said piston, a clamp slot provided in said clamp; a chain mount block disposed in said clamp slot; and a clamp pin projecting through said clamp and said chain mount block, whereby said chain mount block is pivotally mounted in said clamp slot; a chain having one end attached to said chain mount block, said chain adapted for wrapping around the stake and removably securing said piston to the stake; and a gasoline engine having an engine shaft adapted for coupling to said hydraulic fluid pump in driving relationship for operating said hydraulic fluid pump, reciprocating said piston in said hydraulic cylinder and removing the stake responsive to manipulation of said hydraulic control valve.

2. The stake pulling apparatus of claim 1 further comprising a slot provided in said base plate and wheels rotatably carried by said frame for maneuvering said slot into registration with the stake and locating said hydraulic cylinder over the stake.

3. A stake pulling apparatus for removing a stake embedded in the ground, comprising a bifurcated base adapted for engaging the ground, a length of hollow tubing provided in fixed attachment to said base and upward-standing from said base in substantially perpendicular relationship for containing a supply of hydraulic fluid; a hydraulic pump carried by said tubing and provided in fluid communication with the hydraulic fluid in said tubing; a hydraulic control valve carried by said tubing and provided in fluid communication with said hydraulic pump for controlling the flow of hydraulic fluid from said tubing to said hydraulic control valve; a hydraulic cylinder having a cylinder element pivotally suspended from said tubing and a piston element carried by said cylinder element in downwardly-extending, reciprocating relationship, said hydraulic cylinder provided in fluid communication with said hydraulic control valve for operating said hydraulic cylinder responsive to manipulation of said control valve; a clamp carried by said piston element in said hydraulic cylinder, a clamp slot provided in said clamp, a chain mount block disposed in said clamp slot and a clamp pin projecting through said clamp and said chain mount block, whereby said chain mount block is pivotally mounted in said clamp slot; a chain having one end attached to said chain mount block, said chain adapted for wrapping around the stake for connecting said chain mount block to the stake; and power means carried by said tubing and connected in driving relationship to said hydraulic pump, whereby hydraulic fluid is pumped from said tubing through said hydraulic pump and said control valve to said cylinder element of said hydraulic cylinder and from said cylinder element back to said tubing responsive to operation of said power means and manipulation of said control valve, for selectively retracting said piston element into said cylinder element and removing the stake from the ground.

4. The stake pulling apparatus of claim 3 wherein said power means further comprises a gasoline engine.

* * * * *